US010183304B2

(12) United States Patent
Puviland et al.

(10) Patent No.: US 10,183,304 B2
(45) Date of Patent: Jan. 22, 2019

(54) DEVICE FOR PACKAGING AND DISPENSING PASTY PRODUCTS

(71) Applicant: LABLABO, Juvigny (FR)

(72) Inventors: Patrice Puviland, Eteaux (FR); Jean-Philippe Taberlet, Villard (FR)

(73) Assignee: LABLABO, Juvigny (FR)

( * ) Notice: Subject to any disclaimer, the term of this patent is extended or adjusted under 35 U.S.C. 154(b) by 0 days.

(21) Appl. No.: 15/317,530

(22) PCT Filed: Apr. 14, 2015

(86) PCT No.: PCT/FR2015/050992
§ 371 (c)(1),
(2) Date: Dec. 9, 2016

(87) PCT Pub. No.: WO2015/189489
PCT Pub. Date: Dec. 17, 2015

(65) Prior Publication Data

US 2017/0120275 A1 May 4, 2017

(30) Foreign Application Priority Data

Jun. 10, 2014 (FR) ..... 14 55234

(51) Int. Cl.
*B05B 11/00* (2006.01)

(52) U.S. Cl.
CPC ..... *B05B 11/3047* (2013.01); *B05B 11/0013* (2013.01); *B05B 11/0043* (2013.01);
(Continued)

(58) Field of Classification Search
CPC ..... B05B 11/0013; B05B 11/0043; B05B 11/0097; B05B 11/3023; B05B 11/3047; B05B 11/3074
See application file for complete search history.

(56) References Cited

U.S. PATENT DOCUMENTS 3,420,413 A * 1/1969 Corsette ..... B05B 11/0043 222/107
5,509,584 A 4/1996 Gueret
(Continued)

FOREIGN PATENT DOCUMENTS

JP 2009166862 7/2009
WO 2015004360 1/2015

OTHER PUBLICATIONS

Search Report dated Jul. 7, 2015.

*Primary Examiner* — Frederick C Nicolas
*Assistant Examiner* — Bob Zadeh
(74) *Attorney, Agent, or Firm* — Ipsilon USA, LLP

(57) ABSTRACT

A device for packaging and dispensing pasty products, includes a rigid bottle (1) bearing a pump body (2) mounted on a ring (3) that is fixed in the neck of the rigid bottle (1), having a lower peripheral annular stop rib (8) that engages with a clip-fastening collar (12) borne by the pump body in order to fix the pump body (2) to the ring (3). This ring (3) is secured to the neck of a pouch (4) that has a deformable and flexible wall and contains the product to be dispensed, the pump body (2) bearing, above the clip-fastening collar (12), a seal (5) accommodated in an annular groove (6) in the pump body. At least the stop rib or the clip-fastening collar (8, 12) is provided with at least one vent hole (11).

7 Claims, 5 Drawing Sheets

(52) U.S. Cl.
CPC .... *B05B 11/00412* (2018.08); *B05B 11/3023* (2013.01); *B05B 11/3074* (2013.01); *B05B 11/0097* (2013.01)

(56) References Cited

U.S. PATENT DOCUMENTS

| | | | | |
|---|---|---|---|---|
| 5,813,571 | A * | 9/1998 | Gaucher | B05B 11/0043 222/105 |
| 6,073,805 | A | 6/2000 | Gueret | |
| 6,666,355 | B2 * | 12/2003 | Padar | B05B 11/0016 141/65 |
| 8,534,506 | B2 * | 9/2013 | Bohnisch | B05B 11/0043 222/105 |
| 8,608,029 | B2 * | 12/2013 | Lee | A45D 34/00 222/135 |
| 8,998,020 | B2 * | 4/2015 | Sato | B65D 77/0493 220/23.83 |
| 2005/0029291 | A1 * | 2/2005 | Arghyris | B05B 11/0043 222/94 |
| 2007/0068593 | A1 | 3/2007 | Behar et al. | |
| 2008/0245758 | A1 * | 10/2008 | Geser | A61M 15/0065 215/200 |
| 2011/0095053 | A1 * | 4/2011 | Greiner-Perth | B05B 11/0018 222/105 |
| 2015/0102064 | A1 * | 4/2015 | Taberlet | B05B 11/3047 222/153.05 |
| 2016/0354795 | A1 * | 12/2016 | Taberlet | B05B 11/0013 |
| 2017/0120275 | A1 * | 5/2017 | Puviland | B05B 11/0013 |

* cited by examiner

DEVICE FOR PACKAGING AND DISPENSING PASTY PRODUCTS

RELATED APPLICATIONS

This application is a National Phase Application of PCT/FR2015/050992 filed on Apr. 14, 2015, which in turn claims the benefit of priority from FR 14 55234, the entirety of which are incorporated herein by reference.

BACKGROUND

Field of the Invention

The invention relates to a device for packaging and dispensing pasty products.

Description of Related Art

As shown in FIGS. 1 and 2, a known device for packaging and dispensing pasty products comprises a rigid bottle 1 bearing a pump body 2 mounted on a ring 3 that is fixed in the neck of the rigid bottle 1 and is secured to the neck of a pouch 4 that has a deformable and flexible wall and contains the product to be dispensed. The pump body 2 comprises a lower part that is introduced into and clip-fastened in the orifice of the ring 3 and bears a seal 5 accommodated in an annular groove 6 arranged in this lower part and formed by a lower rib 7 and an upper rib 7' that are borne by this lower part. The ring 3 is furthermore attached to the pouch by welding and clip-fastened in the bottle 1.

This annular groove 6 for accommodating the seal ensures that the latter is held and avoids loss thereof before the pump is fitted in the pouch during final packaging, this seal ensuring that the device is airtight in the long term. It ensures the airtight nature, referred to as "airless", of the device.

The orientation terms of the type "upper" or "lower" presume here that the bottle is disposed vertically on its base.

In FIG. 1, the pump body is being mounted on the bottle, and in FIG. 2, it is in the mounted position.

The lower end of this pump body comprises a clip-fastening collar 12 which is force-fitted on a lower annular stop rib 8 borne by the orifice of the ring 3, and the seal 5 held in its groove 6 is then slid over this stop rib 8 of the ring, along the peripheral surface of the ring 3, until the lower rib 7 forming the groove 6 of the seal butts against the stop rib 8 of the ring.

Such a known arrangement raises the following technical problem.

The pouch 4 is filled before the body of the pump is mounted and, in general, there is a certain volume of air above the surface of the product in the pouch. As a result, a random number of initial pumping operations are required when the device is used for the first time, in order to evacuate this air. These initial pumping operations are detrimental to optimum ease and effectiveness of use.

In order to avoid these initial pumping operations when the device is used for the first time, the pouch 4 is intended to be filled to the maximum with packaged product before the body of the pump is mounted, in order fill the central hollow shaft 9 of the pump body, through which the product is evacuated via the lower valve 10 of the pump, to the maximum.

However, it is then found that product passes into the space between the ring 3 and the lower part of the body of the pump and, more specifically, above the stop rib 8 borne by the orifice of the ring 3. During the mounting of the pump body, the product introduced is then trapped between this stop rib 8 borne by the orifice of the ring 3 and the seal 5 which, accommodated in its groove 6, cannot deform, as illustrated in FIG. 1. Being incompressible, this trapped product forms a rigid zone which prevents the continuation of the mounting of the body of the pump into the clip-fastened position shown in FIG. 2.

OBJECTS AND SUMMARY

The invention solves this problem by way of an improvement that is particularly simple to manufacture without reducing the retention force of the pump body on the ring.

To this end, the invention proposes a device for packaging and dispensing pasty products, comprising a rigid bottle bearing a pump body mounted on a ring that is fixed in the neck of the rigid bottle, comprising a lower peripheral annular stop rib that engages with a clip-fastening collar borne by the pump body in order to fix the pump body to said ring, this ring being secured to the neck of a pouch that has a deformable and flexible wall and contains the product to be dispensed, the pump body bearing, above said clip-fastening collar, a seal accommodated in an annular groove in the pump body, characterized in that at least the stop rib or the clip-fastening collar is provided with at least one vent hole.

According to a preferred embodiment, said vent hole is arranged in said clip-fastening collar borne by the lower part of the pump body.

Advantageously, said vent hole consists of a slot arranged in said rib or said collar.

Preferably, said rib or said collar comprises at least two vent holes distributed around the periphery thereof.

Preferably, said seal is compressed against a cylindrical wall of said ring adjacent to said clip-fastening collar, in the mounted position.

Advantageously, said annular groove is formed by at least one lower rib butting against said lower peripheral annular stop rib, in the mounted position.

Preferably, the device is airtight in the manner referred to as "airless".

BRIEF DESCRIPTION OF THE DRAWINGS

The invention is described in more detail below with the aid of a figure showing a preferred embodiment of the invention.

DETAILED DESCRIPTION

Figure 1:
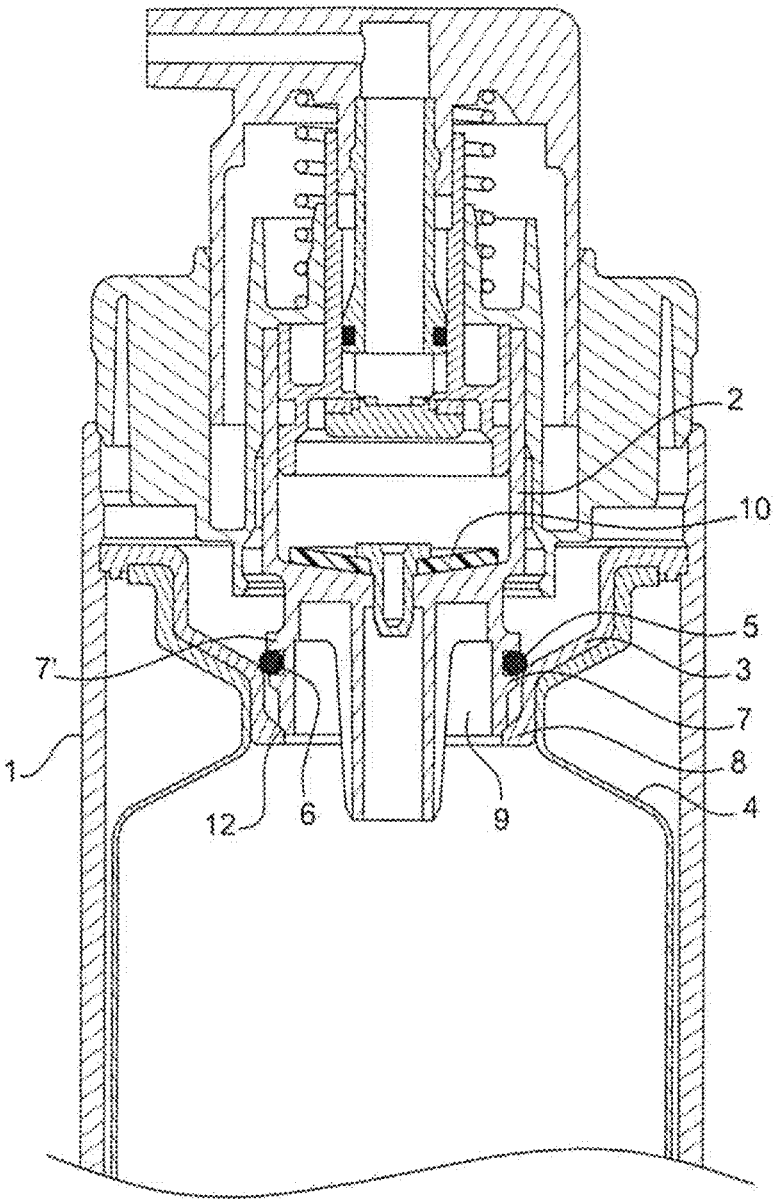
PRIOR ART Fig. 1
FIGS. 1 and 2 are thus views in vertical section of a device for packaging and dispensing pasty products according to the prior art.
Figure 2:
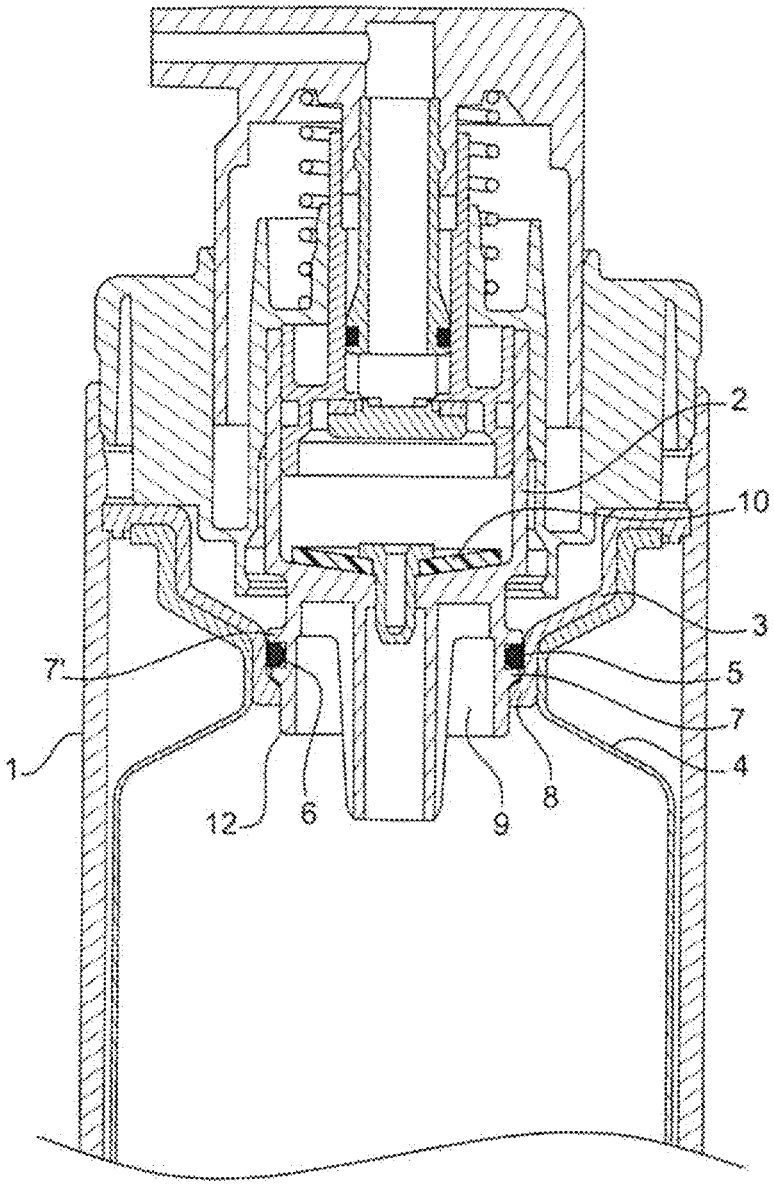
PRIOR ART Fig. 2
Figure 3:
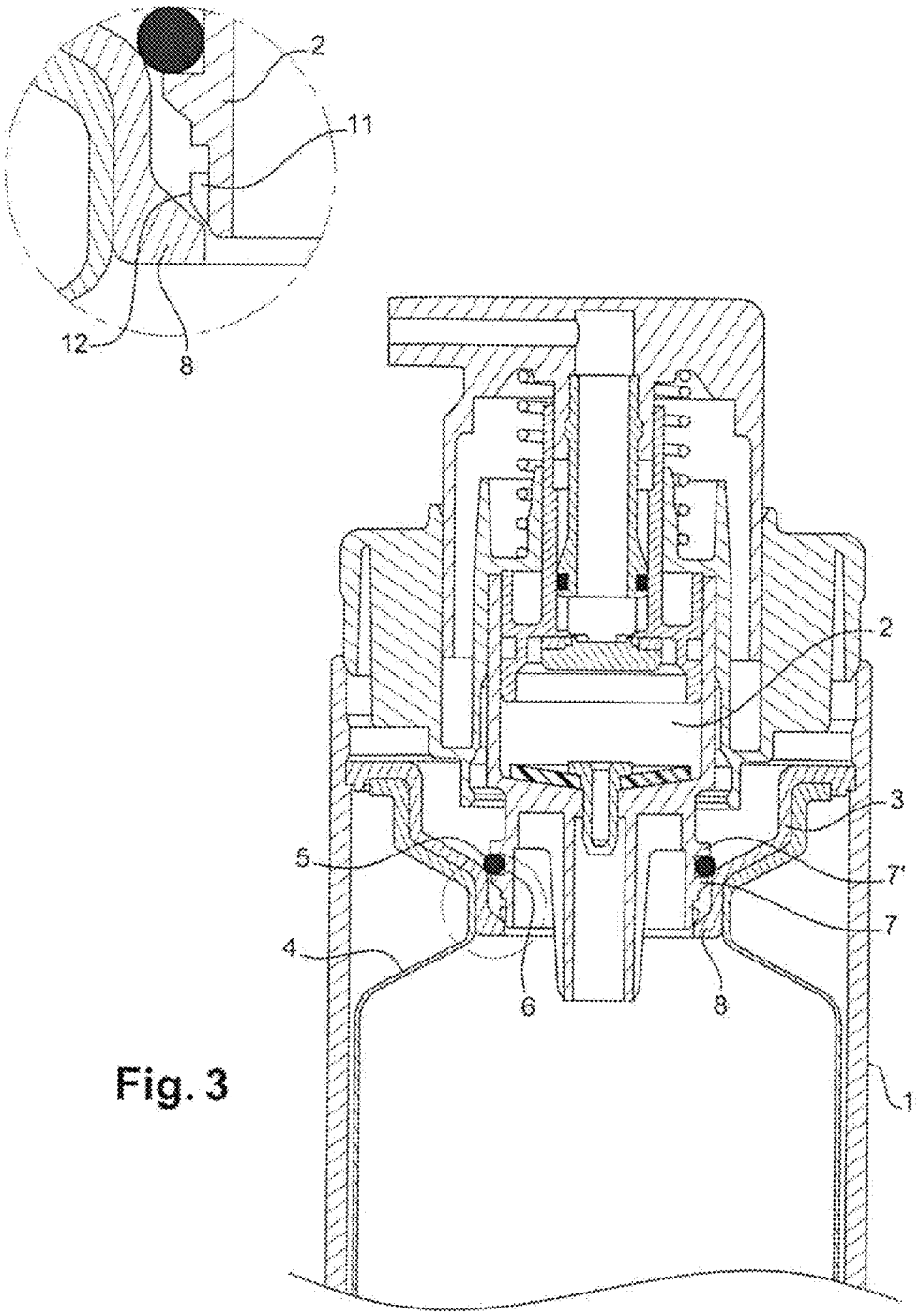
FIG. 3 is a view in vertical section of a device for packaging and dispensing pasty products according to the invention, with an associated detail view and in the mounting position.
Figure 4:
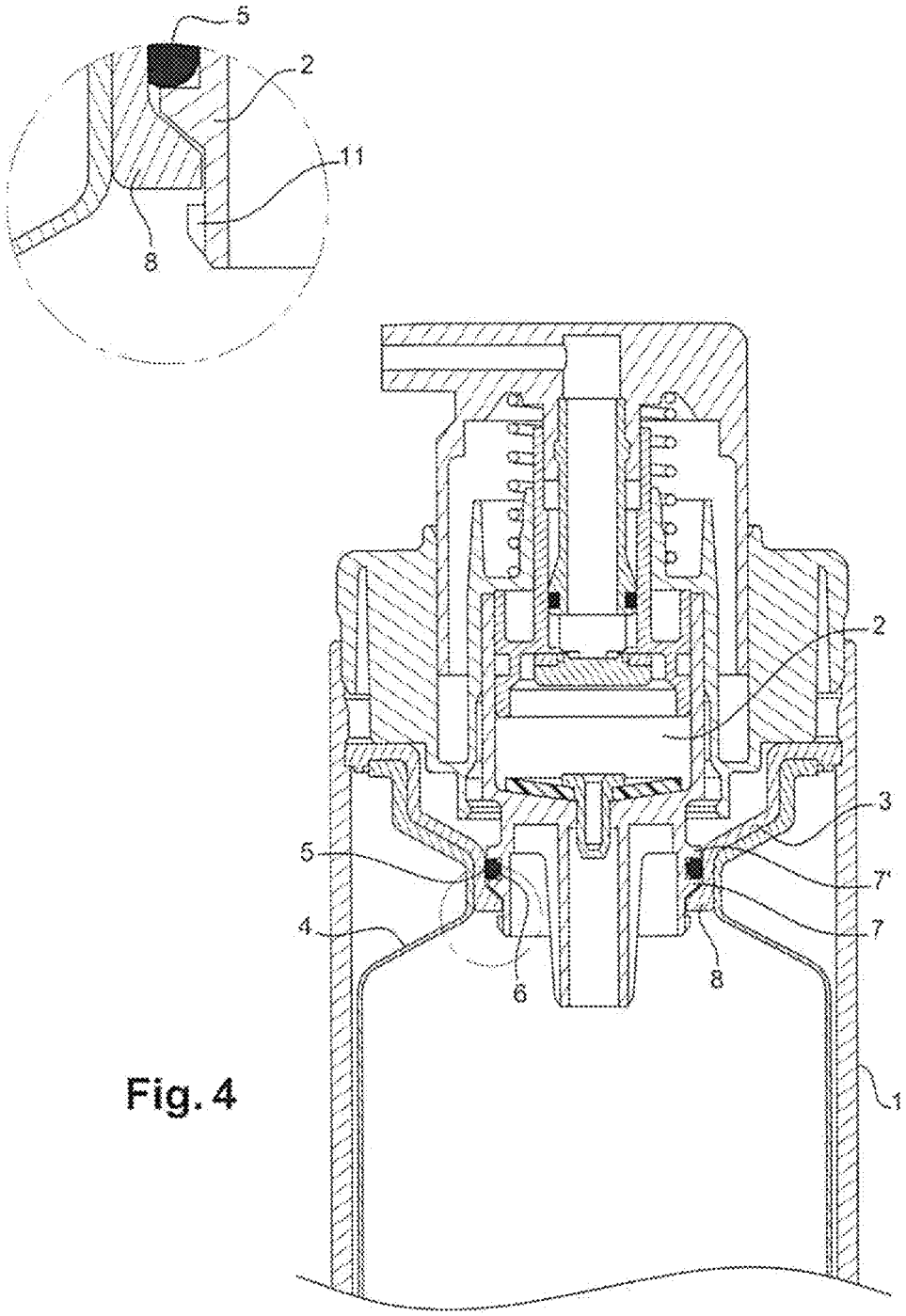
FIG. 4 is a view in vertical section of a device for packaging and dispensing pasty products according to the invention, with an associated detail view and in the mounted position.

As shown in FIGS. 3 and 4, according to the invention, a device for packaging and dispensing pasty products comprises a rigid bottle 1 bearing a pump body 2 mounted on a ring 3 that is fixed in the neck of the rigid bottle 1, comprising a lower peripheral annular stop rib 8 that engages with a clip-fastening collar 12 borne by the pump body, and is secured to the neck of a pouch that has a flexible and deformable wall 4 and contains the product to be dispensed.

The pump body 2 comprises a lower part that is introduced into and clip-fastened in the orifice of the ring 3 and bears an O-ring seal 5 accommodated in an annular groove 6 arranged in this lower part and formed by a lower rib 7 and an upper rib 7' that are borne by this lower part.

At least the stop rib or the clip-fastening collar 8, 12 is provided with at least one vent hole 11.

According to the embodiment shown, there are two vent holes 11 that are distributed around the periphery of the rib and are arranged in the clip-fastening collar 12 borne by the lower part of the pump body.

Figure 5:
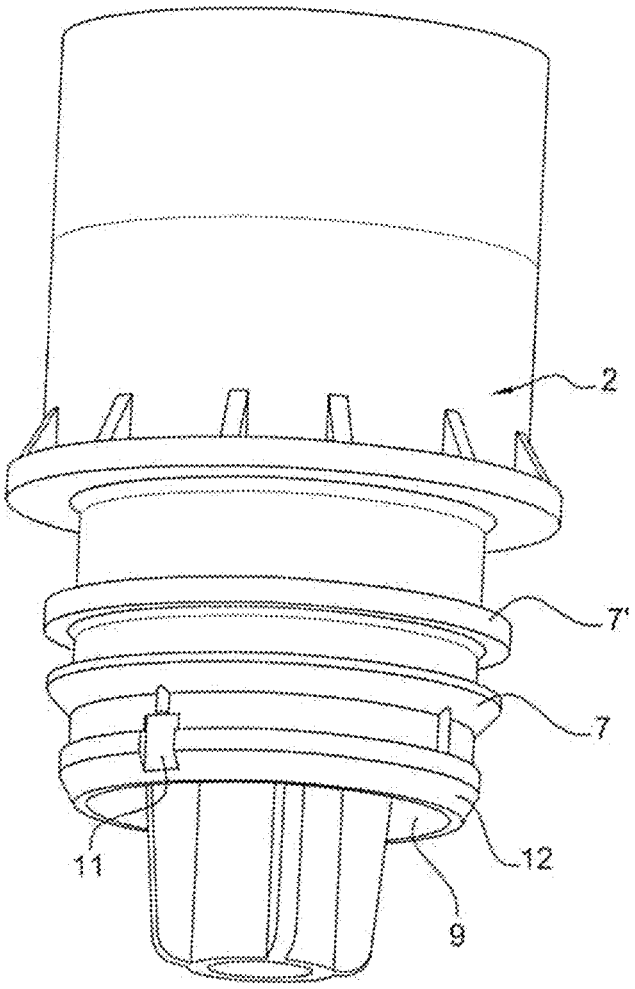
FIG. 5 is a perspective view of a pump body of a device for packaging and dispensing pasty products according to the invention.

As can be seen more clearly in FIG. 5, each vent hole 11 consists of a slot of calibrated size arranged in the clip-fastening collar 12.

By virtue of the invention, when product introduced into the space between the ring 3 and the lower part of the body of the pump and, more specifically, above the stop rib 8 borne by the orifice of the ring 3, is trapped, during mounting, between this stop rib 8 and the lower rib 7 forming the groove 6 of the seal, as illustrated in FIG. 3, it can be evacuated into the pouch 4 through the vent holes 11 during the downward pressure of the lower rib 7 of the groove on this product, which is thus reintroduced into the pouch 4. At the end of mounting, the lower rib 7 of the groove 6 of the seal butts against the stop rib 8 borne by the orifice of the ring 3, by means of two surfaces of identical inclination which block flat surfaces against one another by abutment.

It is thus possible to fill the pouch 4 and the central hollow shaft 9 of the pump body to the maximum with packaged product before the body of the pump is mounted, and thus to control the number of initial pumping operations when the device is used for the first time.

The invention claimed is:

1. Device for packaging and dispensing pasty products, comprising:

a rigid bottle bearing a pump body mounted on a ring that is fixed in a neck of the rigid bottle, the ring at a lower end having a lower peripheral annular stop rib that engages with a clip-fastening collar borne by the pump body in order to fix the pump body to said ring, said ring also being secured at an upper end to a neck of a pouch that has a deformable and flexible wall and contains a product to be dispensed, the pump body bearing, above said clip-fastening collar, a seal accommodated in an annular groove in the pump body, wherein at least said lower peripheral annular stop rib or said clip-fastening collar is provided with at least one vent hole.

2. Device according to claim 1, wherein said at least one vent hole is arranged in said clip-fastening collar borne by a lower part of the pump body.

3. Device according to claim 1, wherein said at least one vent hole is a slot arranged in said lower peripheral annular stop rib or clip-fastening collar.

4. Device according to claim 1, wherein either one of said at least said lower peripheral annular stop rib or said clip-fastening collar has at least two vent holes, said at least two vent holes being distributed around a periphery of said lower peripheral annular stop rib or said clip fastening collar.

5. Device according to claim 1, wherein said seal is compressed against a cylindrical wall of said ring adjacent to said clip-fastening collar, in a mounted position.

6. Device according to claim 1, wherein said annular groove is formed by at least one lower rib butting against said lower peripheral annular stop rib, in a mounted position.

7. Device according to claim 1, wherein said device is airtight or airless.

* * * * *